US008624517B2

(12) United States Patent
Lin et al.

(10) Patent No.: US 8,624,517 B2
(45) Date of Patent: Jan. 7, 2014

(54) LED DIMMING DRIVE DEVICE, METHOD AND LCD

(75) Inventors: Po-shen Lin, Shenzhen (CN); Liang-chan Liao, Shenzhen (CN); Xiang Yang, Shenzhen (CN)

(73) Assignee: Shenzhen China Star Optoelectronics Technology., Ltd., Shenzhen (CN)

( * ) Notice: Subject to any disclaimer, the term of this patent is extended or adjusted under 35 U.S.C. 154(b) by 138 days.

(21) Appl. No.: 13/377,545

(22) PCT Filed: Sep. 26, 2011

(86) PCT No.: PCT/CN2011/080161

§ 371 (c)(1), (2), (4) Date: Dec. 10, 2011

(87) PCT Pub. No.: WO2013/040797

PCT Pub. Date: Mar. 28, 2013

(65) Prior Publication Data

US 2013/0069553 A1 Mar. 21, 2013

(30) Foreign Application Priority Data

Sep. 20, 2011 (CN) ..... 2011 1 0280147

(51) Int. Cl.
*H05B 37/02* (2006.01)

(52) U.S. Cl.
USPC ..... 315/224

(58) Field of Classification Search
None
See application file for complete search history.

(56) References Cited

U.S. PATENT DOCUMENTS

| | | | | |
|---|---|---|---|---|
| 8,288,967 | B2 * | 10/2012 | Liu | 315/360 |
| 2006/0214603 | A1 * | 9/2006 | Oh et al. | 315/246 |
| 2007/0195552 | A1 * | 8/2007 | Park | 362/613 |

* cited by examiner

*Primary Examiner* — Crystal L Hammond

(57) ABSTRACT

A light emitting diode (LED) dimming drive device, an LED dimming drive method and a liquid crystal display (LCD) are disclosed. The LED dimming drive device comprises a plurality of dimming control circuits each comprising one dimmer switch and a delay setting circuit for setting a different delay time for each dimming control circuits. Each of the dimming control circuits further comprises a clock delay circuit for receiving a pulse width modulation (PWM) signal, timing according to the delay time, and outputting the PWM signal to the dimmer switch when the delay time expires. Different delay times can be used to control the output of PWM signals and further control the on or off of the dimmer switches. This can avoid the noises or electromagnetic (EM) interferences occurred by a large amount of energy transmitted into the LED paths when the dimmer switches is turned on.

13 Claims, 4 Drawing Sheets

LED DIMMING DRIVE DEVICE, METHOD AND LCD

BACKGROUND

1. Technical Field

The present disclosure relates to the field of LED technologies, and more particularly, to a light emitting diode (LED) dimming drive device, an LED dimming drive method and a liquid crystal display (LCD).

2. Description of Related Art

With continuous advancement of the liquid crystal display (LCD) technologies, more and more manufacturers now choose to use light emitting diodes (LEDs) as backlight sources in LCD panels. Use of LEDs as backlight sources in LCD panels provides a lot of advantages; for example, the LCD panels can be made to have a smaller size, a longer service life, a shorter response time, a lower power consumption and much better color performance than the conventional cold cathode fluorescent lamps (CCFLs).

As the LED technologies advance continuously, requirements on dimming performance of LEDs become increasingly stricter. In the conventional LED dimming drive devices, generally a pulse width modulation (PWM) signal is output to each of a plurality of dimming control circuits simultaneously, so as to control the dimming control circuits simultaneously. In practical implementations, the LEDs are turned on or off by using the PWM signal to control a dimmer switch in each of the dimming control circuit to be turned on or off, and the dimmer switch may be implemented by a metal-oxide-semiconductor (MOS) transistor.

Hereinafter, one dimming control circuit will be taken as an example to illustrate a dimming process in the prior art. When a PWM signal inputted into a certain dimming control circuit is at a high level, the dimmer switch in the dimming control circuit will be turned on by the high-level PWM signal to switch on an LED which connected with the dimming control circuit; conversely, when the PWM signal is at a low level, the dimmer switch in the dimming control circuit is turned off by the low-level PWM signal so as to switch off the LED which connected with the dimming control circuit.

However, in the prior art, LEDs in all LED paths are switched on simultaneously, so a large amount of energy must be provided for the whole LED light emitting system within a short time. This may cause loud noises and strong electromagnetic interferences (EMI) and even instable operation of the PWM power supply system.

BRIEF SUMMARY

A primary objective of the present disclosure is to provide an LED dimming drive device, an LED dimming drive method and an LCD capable of effectively avoiding noises and reducing EMI.

The present disclosure provides a light emitting diode (LED) dimming drive device, which comprises a plurality of dimming control circuits each comprising one dimmer switch. The dimmer switch is adapted to control a corresponding LED path to be switched on or off. The LED dimming drive device further comprises:

a delay setting circuit, being configured to set a different delay time for each of the dimming control circuits;

wherein each of the dimming control circuits further comprises:

a clock delay circuit, being configured to receive a pulse width modulation (PWM) signal, count the time according to the delay time, and output the PWM signal to the dimmer switch when the delay time expires.

Preferably, the dimmer switch is a high-voltage metal-oxide-semiconductor (MOS) transistor.

Preferably, each of the dimming control circuits further comprises:

a first discharge suppression circuit connected with the dimmer switch, being configured to cut off a discharging circuit presented by a parasitic capacitor of the dimmer switch to the clock delay circuit when the LED path is switched off.

Preferably, the first discharge suppression circuit comprises a follower, an in-phase input and a power supply terminal of the follower receive the PWM signal from the clock delay circuit so as to control the follower to be turned on or off, an inverting input of the follower is connected to an output of the follower, and the output of the follower is connected to a grid of the high-voltage MOS transistor to control the high-voltage MOS transistor to be turned on or off.

Preferably, each of the dimming control circuits further comprises:

a second discharge suppression circuit connected with the dimmer switch, being configured to cut off a discharging circuit presented by the parasitic capacitor of the dimmer switch to the dimmer switch when the LED path is switched off.

Preferably, the second discharge suppression circuit comprises a low-voltage MOS transistor, and the low-voltage MOS transistor has a grid for receiving the PWM signal so as to control the low-voltage MOS transistor to be turned on or off, a drain connected to a source of the high-voltage MOS transistor and a source connected to the ground.

Preferably, the clock delay circuit comprises:

a counter, being configured to count the time according to the delay time when the PWM signal is transmitted to the clock delay circuit; and a PWM signal delay module, being configured to receive the PWM signal and output the PWM signal to the dimmer switch when the delay time of the counter expires.

The present disclosure further provides an LED dimming drive method, comprising the following steps of:

setting a different delay time for each of a plurality of dimming control circuits and starting to count the time, and meanwhile, connecting a PWM signal to each of the dimming control circuits; and outputting the PWM signal to a dimmer switch of the dimming control circuit when the delay time of the dimming control circuit expires.

Preferably, the step of setting a different delay time for each of a plurality of dimming control circuits and starting to count the time further comprises:

setting a different delay time for a counter of each of the dimming control circuits; and controlling the counter to count the time according to the delay time when the PWM signal is transmitted to the counter.

Preferably, the step of outputting the PWM signal to a dimmer switch of the dimming control circuit when the delay time of the dimming control circuit expires further comprises:

controlling the dimming control circuit to be switched on when the delay time of the counter expires; and outputting the PWM signal to the dimmer switch so as to control the dimmer switch to be turned on or off.

The present disclosure further provides an LCD comprising an LED dimming drive device. The LED dimming drive device comprises a plurality of dimming control circuits each comprising one dimmer switch. The dimmer switch is adapted to control a corresponding LED path to be switched on or off, and the dimmer switch is a high-voltage MOS transistor. The LED dimming drive device further comprises:

a delay setting circuit, being configured to set a different delay time for each of the dimming control circuits;

wherein each of the dimming control circuits further comprises:

a clock delay circuit, being configured to receive a PWM signal, count the time according to the delay time, and output the PWM signal to the dimmer switch when the delay time expires; and a first discharge suppression circuit connected with the dimmer switch, being configured to cut off a discharging circuit presented by a parasitic capacitor of the dimmer switch to the clock delay circuit when the LED path is switched off;

the first discharge suppression circuit comprises a follower, an in-phase input and a power supply terminal of the follower receive the PWM signal from the clock delay circuit so as to control the follower to be turned on or off, an inverting input of the follower is connected to an output of the follower, and the output of the follower is connected to a grid of the high-voltage MOS transistor to control the high-voltage MOS transistor to be turned on or off.

According to the present disclosure, time points at which the dimmer switches are turned on or off are controlled by using different delay times to control output of PWM signals. This effectively avoids the noises or EMI that would otherwise occur when transmitting a large amount of energy into the LED paths to turn on the dimmer switches simultaneously, thus making operation of the PWM power supply system more stable.

Additionally, discharge suppression circuits are also used in embodiments of the present disclosure to suppress discharging of the parasitic capacitor of the dimmer switches, thus avoiding the energy loss and noises caused by the discharging of the parasitic capacitor.

Hereinafter, implementations, functional features and advantages of the present disclosure will be further described with reference to embodiments thereof and the attached drawings.

DETAILED DESCRIPTION

It shall be understood that, the embodiments described herein are only intended to illustrate but not to limit the present disclosure.

Figure 1:
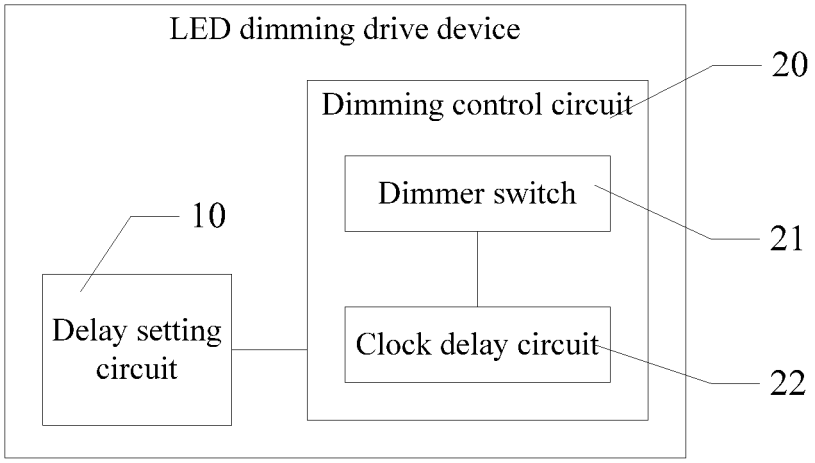
FIG. 1 is a schematic structural view of an LED dimming drive device according to a first embodiment of the present disclosure.

Referring to FIG. 1, there is shown a schematic structural view of an LED dimming drive device according to a first embodiment of the present disclosure.

The LED dimming drive device according to this embodiment of the present disclosure comprises a delay setting circuit 10 and a plurality of dimming control circuits 20. The delay setting circuit 10 is configured to set a different delay time for each of the dimming control circuits 20. Each of the dimming control circuits 20 further comprises:

a dimmer switch 21, being configured to control a corresponding LED path to be switched on or off;

a clock delay circuit 22, being configured to receive a pulse width modulation (PWM) signal, count the time according to the delay time, and output the PWM signal to the dimmer switch 21 when the delay time expires.

In this embodiment, by setting a different delay time for each of the dimming control circuits 20 respectively, each of the clock delay circuits 20 corresponds to a different relay time respectively. Then, as the respective delay times expire, the clock delay circuits 22 will output PWM signals at different times respectively; i.e., the PWM signals are transmitted to control terminals of the dimmer switches 21 at different times, so the dimmer switches 21 will not be turned on simultaneously. As compared to the prior art, the embodiment of the present disclosure effectively avoids the noises or EMI that would otherwise occur when transmitting a large amount of energy into the LED paths to turn on the dimmer switches 21 simultaneously, thus ensuring stable operation of the PWM power supply system.

Figure 2:
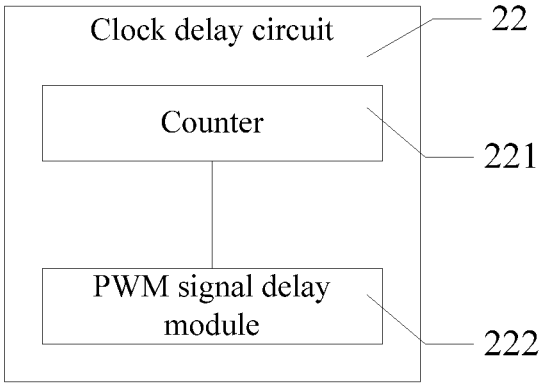
FIG. 2 is a schematic structural view of a clock delay circuit in the LED dimming drive device according to the first embodiment of the present disclosure.

Referring to FIG. 2, there is shown a schematic structural view of a clock delay circuit in the LED dimming drive device according to the first embodiment of the present disclosure. In this embodiment, the clock delay time 22 further comprises:

a counter 221, being configured to count the time according to the delay time when the PWM signal is transmitted to the clock delay circuit 22; and a PWM signal delay module 222, being configured to receive the PWM signal and output the PWM signal to the dimmer switch 21 when the delay time of the counter 221 expires.

In this embodiment, each clock delay circuit 22 corresponds to one counter 221, and a different delay time is set for each counter 221 via the delay setting circuit 10 respectively. Then, when the PWM signal is transmitted to the clock delay circuit 22, the counter 221 begins to count, and once the delay time which is preset for the counter 221 of the clock delay circuit 22 expires, the PWM signal delay module 222 outputs a high-level PWM signal to the dimmer switch 21 of the corresponding circuit to turn on the dimmer switch 21.

According to this embodiment, by using different delay times to control the PWM signal delay modules 222 to output PWM signals respectively, the PWM signals will be transmitted to control terminals of the dimmer switches 21 at different times. This effectively avoids the noises or EMI that would otherwise occur when transmitting a large amount of energy into the LED paths to turn on the dimmer switches 21 simultaneously, thus ensuring stable operation of the PWM power supply system.

Figure 3:
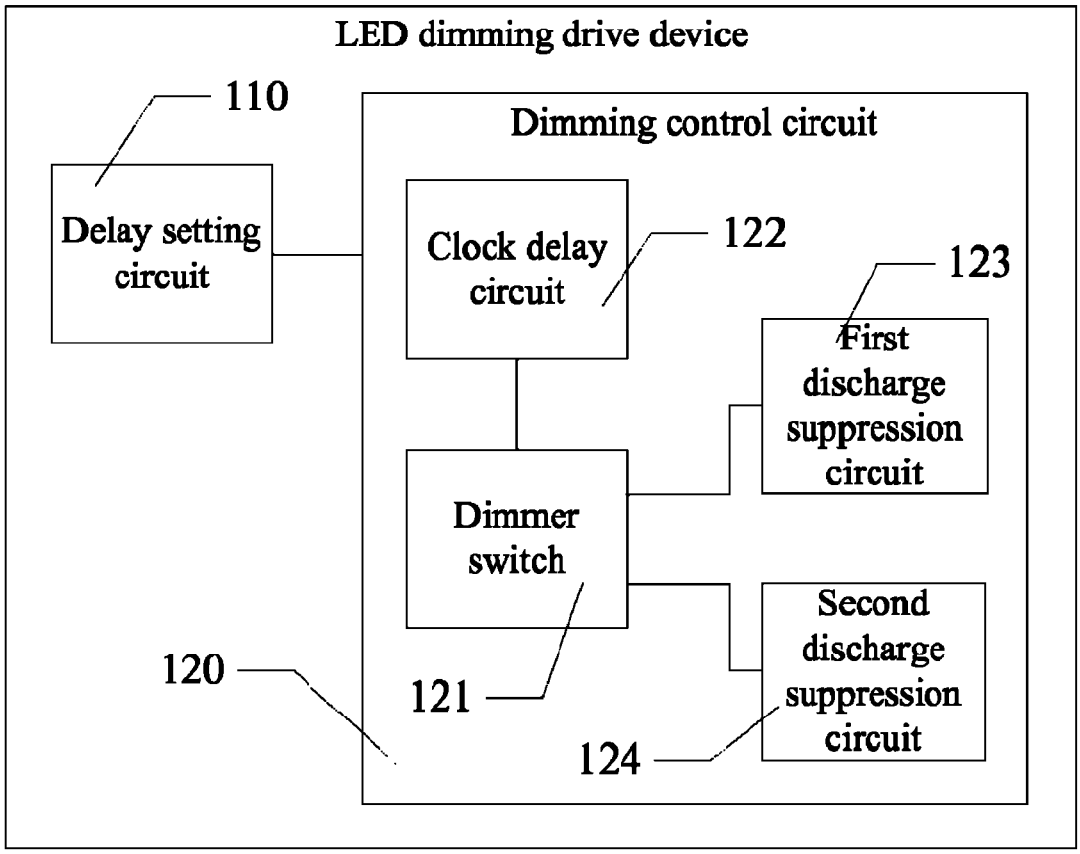
FIG. 3 is a schematic structural view of an LED dimming drive device according to a second embodiment of the present disclosure.

Referring to FIG. 3, there is shown a schematic structural view of an LED dimming drive device according to a second embodiment of the present disclosure.

In this embodiment, the LED dimming drive device comprises a delay setting circuit 110 and a plurality of dimming control circuits 120. Each of the dimming control circuits 120 further comprises a dimmer switch 121 and a clock delay circuit 122. Both functions and structures of the dimmer switch 121 and the clock delay circuit 122 are the same as those described in the first embodiment, so they will not be further described again herein.

Each of the dimming control circuits 120 in the LED dimming drive device of this embodiment further comprises a first discharge suppression circuit 123 connected with the dimmer switch 121.

The first discharge suppression circuit 123 is configured to cut off a discharging circuit presented by a parasitic capacitor of the dimmer switch 121 to the clock delay circuit 122 when the LED path is switched off.

In this embodiment, the dimmer switch 121 may be a high-voltage MOS transistor which can withstand a voltage of 60-500V or higher. The first discharge suppression circuit 123 can suppress the discharging of the clock delay circuit 122 caused by the parasitic capacitor of the high-voltage MOS transistor. The first discharge suppression circuit 123 comprises a follower. A power supply terminal of the follower is adapted to receive the delayed PWM signal for controlling the follower to be turned on or off. The delayed PWM signal is also inputted to an in-phase input of the follower, and an output of the follower is connected with a grid of the high-voltage MOS transistor to output a control signal that is in phase with the PWM signal, so that the high-voltage MOS transistor is controlled to be turned on or off.

In this embodiment, the follower is turned off when the PWM signal is at a low level, so it is impossible for the parasitic capacitor of the high-voltage MOS transistor to be discharged through the clock delay circuit 122 in which the follower is located. Thus, the energy loss and noises caused by the discharging of the parasitic capacitor is avoided.

Further, the dimming control circuit 120 in the LED dimming drive device of this embodiment may further comprise a second discharge suppression circuit 124 connected with the dimmer switch 121. The second discharge suppression circuit 124 is configured to cut off a discharging circuit presented by the parasitic capacitor of the dimming switch 121 to the dimmer switch 121 when the LED path is switched off.

In this embodiment, the dimmer switch 121 is a high-voltage MOS transistor, and the second discharge suppression circuit comprises a low-voltage MOS transistor (which can withstand a voltage of lower than 60V). A grid of the low-voltage MOS transistor is adapted to receive the delayed PWM signal for controlling the low-voltage MOS transistor to be turned on or off. A drain of the low-voltage MOS transistor is connected to a source of the high-voltage MOS transistor, and a source of the low-voltage MOS transistor is grounded. The low-voltage MOS transistor is turned off and a source of the high-voltage MOS transistor is open when the PWM signal is at a low level, so it is impossible for the grid of the high-voltage MOS transistor to be discharged via the grounding circuit by the parasitic capacitor. This ensures that the LED path is completely cut off by securely turning off the high-voltage MOS transistor, thus further avoiding the energy loss and noises caused by the discharging of the parasitic capacitor.

Figure 4:
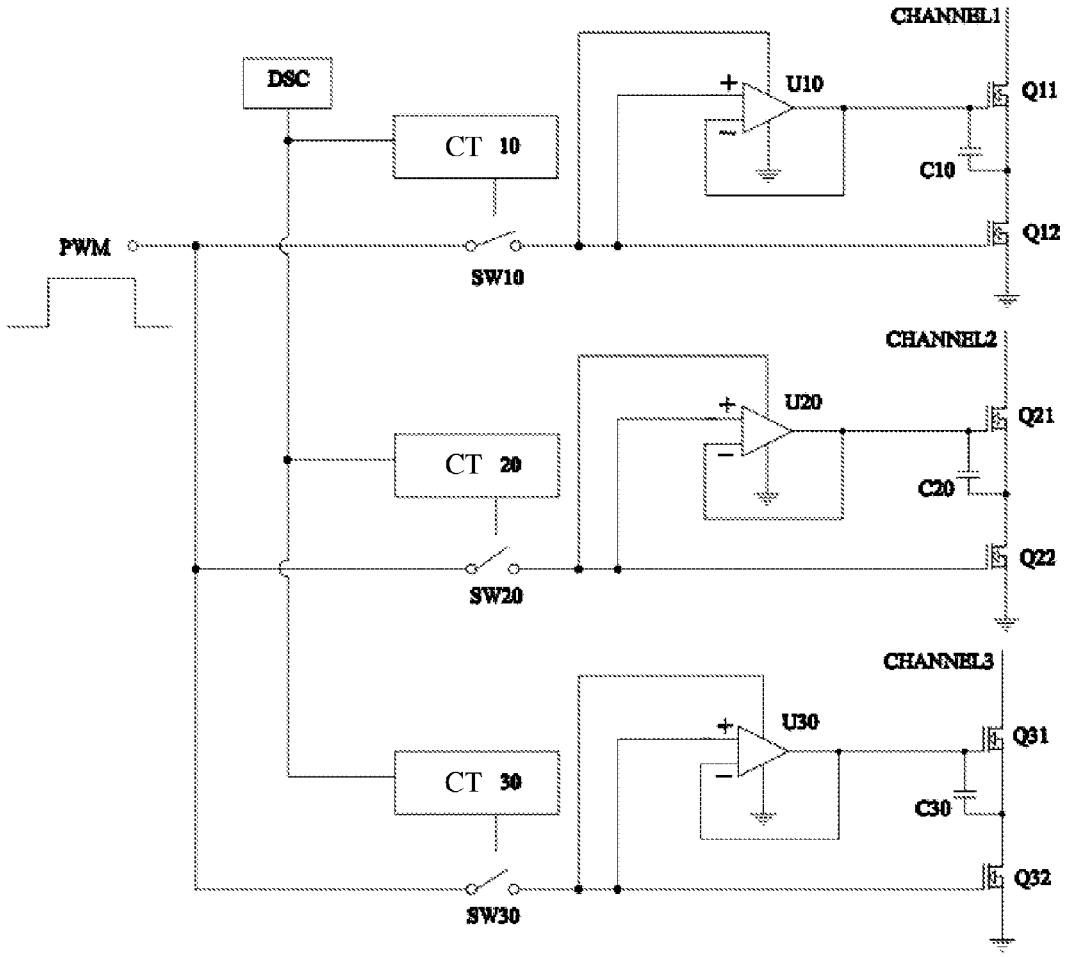
FIG. 4 is a circuit diagram of the LED dimming drive device according to the second embodiment of the present disclosure.

Referring to FIG. 4, there is shown a circuit diagram of the LED dimming drive device according to the second embodiment of the present disclosure.

In this embodiment, three LED dimming paths are described as an example, and the delay setting circuit 110 is implemented as a delay setting circuit DSC in this embodiment. Counters in the clock delay circuit include three counters (CT 10, CT 20, CT 30). The PWM signal delay module in the clock delay circuit comprises three timing switcher SW10, SW20 and SW30. The dimming switch 121 further comprises a high-voltage MOS transistor Q11, a high-voltage MOS transistor Q21 and a high-voltage MOS transistor Q31.

In the LED dimming drive device of this embodiment, each of the clock delay circuit DSC is provided with timing switches SW10, SW20 and SW 30 corresponding to the counters Counter 10, Counter 20, Counter 30 respectively. The delay setting circuit DSC sets a different delay time for each of the counters Counter 10, Counter 20 and Counter 30 respectively. Then, when the PWM signals are transmitted to the counters Counter 10, Counter 20, Counter 30 respectively, the counters begin to count the time according to respective preset delay times. Once the delay time of a counter expires, the timing switch corresponding to the counter will be turned on so that the corresponding PWM signal is output to a subsequent section of the circuit. For example, if a delay time of 16 ms is preset for the counter Counter 10, a delay time of 32 ms is preset for the counter Counter 20 and a delay time of 48 ms is preset for the counter Counter 30, then when the delay time of 16 ms of the counter Counter 10 expires, the timing switch SW10 is turned on so that the PWM signal is outputted to a path where the high-voltage MOS transistor is located. On the other hand, the counters Counter 20 and Counter 30 are still clocking the time until their respective delay times expire.

By ensuring that the PWM signal are not transmitted to the PWM clock delay circuits synchronously, this embodiment effectively avoids the noises or EMI that would otherwise occur when transmitting a large amount of energy into the LED paths to turn on the high-voltage MOS transistors Q11, Q21 and Q31 simultaneously, thus ensuring stable operation of the PWM power supply system.

This embodiment is further able to suppress the discharging that occurs via the parasitic capacitors C10, C20 and C30 of the high-voltage MOS transistors Q11, Q21 and Q31. The first discharging suppression circuits described above comprise followers U10, U20 and U30 respectively, and the second discharging suppression circuits described above comprise low-voltage MOS transistors Q12, Q22 and Q32 respectively. Taking the first PWM clock delay circuit and the first LED path as an example, an in-phase input of the follower U10 receives the delayed PWM signal, an inverting input of the follower U10 is connected to an output of the follower, and the output of the follower U10 is connected to a grid of the high-voltage MOS transistor Q11 to output a pulse control signal in phase with the PWM signal for controlling the high-voltage MOS transistor Q11 to be turned on or off. The PWM signal is also outputted to a power supply terminal of the follower U10 to control the follower U10 to be turned on or off. When the PWM signal is at a high level, the follower U10 is turned on to output a high-level pulse control signal so that the high-voltage MOS transistor Q11 is turned on. Conversely, when the PWM signal is at a low level, the follower U10 is turned off and, correspondingly, the path in which the follower U10 is located is cut off, which makes it impossible for the parasitic capacitor C10 of the high-voltage MOS transistor Q11 to be discharged through the circuit where the follower U10 is located; consequently, the energy loss and noises caused by the discharging of the parasitic capacitor C10 is avoided.

Additionally, a grid of the low-voltage MOS transistor Q12 also receives the delayed PWM signal for controlling the low-voltage MOS transistor Q12 to be turned on or off. A drain of the low-voltage MOS transistor Q12 is connected to a source of the high-voltage MOS transistor Q11, and a source of the low-voltage MOS transistor Q12 is grounded. When the PWM signal is at a high level, the low-voltage MOS transistor Q12 is turned off and a source of the high-voltage MOS transistor Q11 is grounded, so this circuit can operate normally. On the other hand, when the PWM signal is at a low level, the low-voltage MOS transistor Q12 is turned off and the source of the high-voltage MOS transistor Q11 is open, so it is impossible for the grid of the high-voltage MOS transistor Q11 to be discharged via the grounding circuit by the parasitic capacitor C10. This ensures that the LED path is completely cut off by securely turning off the high-voltage MOS transistor, thus further avoiding the energy loss and noises caused by the discharging of the parasitic capacitor C10.

Figure 5:
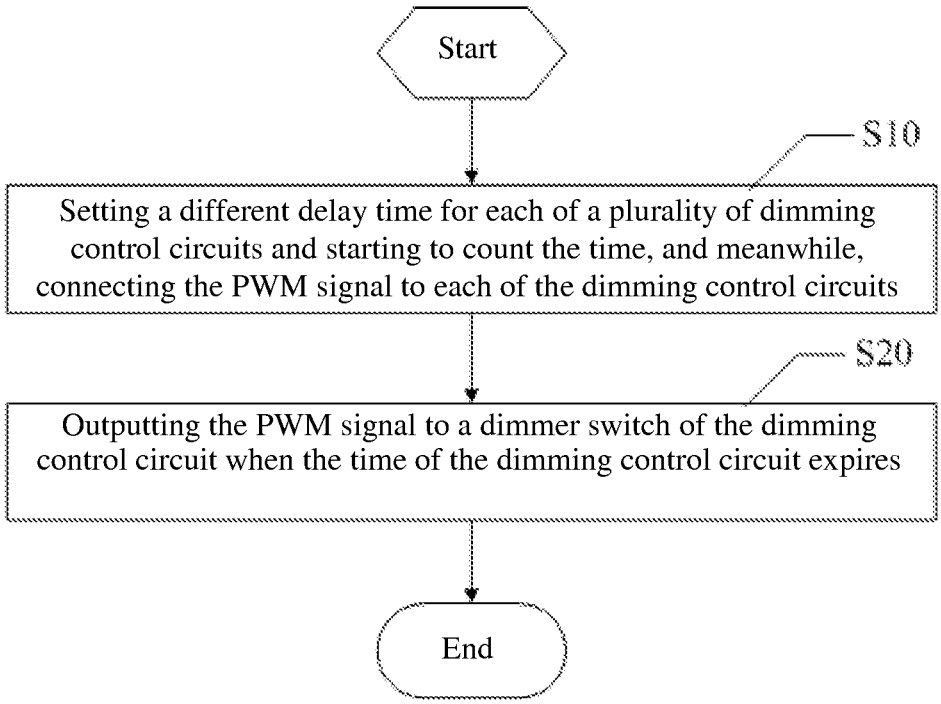
FIG. 5 is a flowchart diagram of an LED dimming drive method according to a third embodiment of the present disclosure.

Referring to FIG. 5, there is shown a flowchart diagram of an LED dimming drive method according to a third embodiment of the present disclosure. The LED dimming drive method of this embodiment comprises the follow steps.

Step S10: setting a different delay time for each of a plurality of dimming control circuits and starting to count the time, and meanwhile, connecting a PWM signal to each of the dimming control circuits.

In this embodiment, this step further comprises: setting a different delay time for a counter of each of the dimming control circuits; and controlling the counter to count the time according to the delay time when the PWM signal is transmitted to the counter.

Step S20: outputting the PWM signal to a dimmer switch of the dimming control circuit when the delay time of the dimming control circuit expires.

In this embodiment, the PWM signal is a dimming signal for driving the dimmer switch in each of the dimming control circuits so that the LED path corresponding to the dimming switch can be switched on or off. When the delay time of the counter expires, the dimming control circuit is turned on and the PWM signal is transmitted to a control terminal of the dimmer switch to control the dimmer switch to be turned on or off. If the PWM signal is at a high level, then the dimmer switch is turned on so that the LED path is switched on; and conversely, if the PWM signal is at a low level, then the dimmer switch is turned off so that the LED path is switched off. In this way, this embodiment effectively avoids the noises or EMI that would otherwise occur when transmitting a large amount of energy into the LED paths to turn on the dimmer switches simultaneously, thus ensuring stable operation of the PWM power supply system.

An embodiment of the present disclosure further provides an LCD comprising the LED dimming drive device described above. The LED dimming drive device may comprise:

a plurality of dimming control circuits each comprising one dimmer switch, wherein the dimmer switch is adapted to control a corresponding LED path to be switched on or off, and the dimmer switch is a high-voltage MOS transistor, the LED dimming drive device further comprising:

a delay setting circuit, being configured to set a different delay time for each of the dimming control circuits;

wherein each of the dimming control circuits further comprises:

a clock delay circuit, being configured to receive a PWM signal, count the time according to the delay time, and output the PWM signal to the dimmer switch when the delay time expires; and a first discharge suppression circuit connected with the dimmer switch, being configured to cut off a discharging circuit presented by a parasitic capacitor of the dimmer switch to the clock delay circuit when the LED path is switched off;

the first discharge suppression circuit comprises a follower, an in-phase input and a power supply terminal of the follower receive the PWM signal from the clock delay circuit so as to control the follower to be turned on or off, an inverting input of the follower is connected to an output of the follower, and the output of the follower is connected to a grid of the high-voltage MOS transistor to control the high-voltage MOS transistor to be turned on or off.

Additionally, each of the LED dimming drive devices in the LCD may further comprise:

a second discharge suppression circuit connected with the dimmer switch, being configured to cut off a discharging circuit presented by the parasitic capacitor of the dimmer switch to the dimmer switch when the LED path is switched off.

The LED dimming driving device in the LCD of the present disclosure may contemplate all the technical solutions described in the embodiments shown in FIG. 1 to FIG. 4, and detailed structures, circuits and working principles thereof are just the same as what described in the above embodiments, so no further description will be made herein. As compared to the conventional LCDs, the LCD of the present disclosure that adopts the aforesaid solutions of the LED dimming drive device can effectively reduce occurrence of noises or EMI and also reduce the energy loss and noised caused by discharging of parasitic capacitors, thus making operation of the power supply system stable.

What described above are only preferred embodiments of the present disclosure but are not intended to limit the scope of the present disclosure. Accordingly, any equivalent structural or process flow modifications that are made on basis of the specification and the attached drawings or any direct or indirect applications in other technical fields shall also fall within the scope of the present disclosure.

What is claimed is:

1. A light emitting diode (LED) dimming drive device, comprising a plurality of dimming control circuits each comprising one dimmer switch, the dimmer switch being adapted to control a corresponding LED path to be switched on or off, the LED dimming drive device further comprising:

a delay setting circuit, being configured to set a different delay time for each of the dimming control circuits;

wherein each of the dimming control circuits further comprises:

a clock delay circuit, being configured to receive a pulse width modulation (PWM) signal, count the time according to the delay time, and output the PWM signal to the dimmer switch when the delay time expires;

each of the dimming control circuits further comprises:

a first discharge suppression circuit connected with the dimmer switch, being configured to cut off a discharging circuit presented by a parasitic capacitor of the dimmer switch to the clock delay circuit when the LED path is switched off.

2. The LED dimming drive device of claim 1, wherein the dimmer switch is a high-voltage metal-oxide-semiconductor (MOS) transistor.

3. The LED dimming drive device of claim 2, wherein each of the dimming control circuits further comprises:

a second discharge suppression circuit connected with the dimmer switch, being configured to cut off a discharging circuit presented by the parasitic capacitor of the dimmer switch to the dimmer switch when the LED path is switched off.

4. The LED dimming drive device of claim 3, wherein the second discharge suppression circuit comprises a low-voltage MOS transistor, and the low-voltage MOS transistor has a grid for receiving the PWM signal so as to control the low-voltage MOS transistor to be turned on or off, a drain connected to a source of the high-voltage MOS transistor and a source connected to the ground.

5. The LED dimming drive device of claim 1, wherein the first discharge suppression circuit comprises a follower, an in-phase input and a power supply terminal of the follower receive the PWM signal from the clock delay circuit so as to control the follower to be turned on or off, an inverting input of the follower is connected to an output of the follower, and the output of the follower is connected to a grid of the high-voltage MOS transistor to control the high-voltage MOS transistor to be turned on or off.

6. The LED dimming drive device of claim 1, wherein the clock delay circuit comprises:

a counter, being configured to count the time according to the delay time when the PWM signal is transmitted to the clock delay circuit; and a PWM signal delay module, being configured to receive the PWM signal and output the PWM signal to the dimmer switch when the delay time of the counter expires.

7. An LED dimming drive method, comprising the following steps of:

a delay setting circuit setting a different delay time for each of a plurality of dimming control circuits and starting to count the time, and meanwhile, connecting a PWM signal to each of the dimming control circuits; and a clock delay circuit outputting the PWM signal to a dimmer switch of the dimming control circuit when the delay time of the dimming control circuit expires; and a first discharge suppression circuit cutting off a discharging circuit presented by a parasitic capacitor of the dimmer switch to the clock delay circuit when the LED patch is switched off.

8. The LED dimming drive method of claim 7, wherein the step of a delay setting circuit setting a different delay time for each of a plurality of dimming control circuits and starting to count the time further comprises:

the delay setting circuit setting a different delay time for a counter of each of the dimming control circuits; and the delay setting circuit controlling the counter to count the time according to the delay time when the PWM signal is transmitted to the counter.

9. The LED dimming drive method of claim 8, wherein the step of a clock delay circuit outputting the PWM signal to a dimmer switch of the dimming control circuit when the delay time of the dimming control circuit expires further comprises:

the clock delay circuit controlling the dimming control circuit to be switched on when the delay time of the counter expires; and the clock delay circuit outputting the PWM signal to the dimmer switch so as to control the dimmer switch to be turned on or off.

10. An LCD, comprising an LED dimming drive device, the LED dimming drive device comprising a plurality of dimming control circuits each comprising one dimmer switch, the dimmer switch being adapted to control a corresponding LED path to be switched on or off, the dimmer switch being a high-voltage MOS transistor, the LED dimming drive device further comprising:

a delay setting circuit, being configured to set a different delay time for each of the dimming control circuits; wherein each of the dimming control circuits further comprises:

a clock delay circuit, being configured to receive a PWM signal, count the time according to the delay time, and output the PWM signal to the dimmer switch when the delay time expires; and a first discharge suppression circuit connected with the dimmer switch, being configured to cut off a discharging circuit presented by a parasitic capacitor of the dimmer switch to the clock delay circuit when the LED path is switched off;

the first discharge suppression circuit comprises a follower, an in-phase input and a power supply terminal of the follower receive the PWM signal from the clock delay circuit so as to control the follower to be turned on or off, an inverting input of the follower is connected to an output of the follower, and the output of the follower is connected to a grid of the high-voltage MOS transistor to control the high-voltage MOS transistor to be turned on or off.

11. The LCD of claim 10, wherein each of the dimming control circuits further comprises:

a second discharge suppression circuit connected with the dimmer switch, being configured to cut off a discharging circuit presented by the parasitic capacitor of the dimmer switch to the dimmer switch when the LED path is switched off.

12. The LCD of claim 11, wherein the second discharge suppression circuit comprises a low-voltage MOS transistor, and the low-voltage MOS transistor has a grid for receiving the PWM signal so as to control the low-voltage MOS transistor to be turned on or off, a drain connected to a source of the high-voltage MOS transistor and a source connected to the ground.

13. The LCD of claim 10, wherein the clock delay circuit comprises:

a counter, being configured to count the time according to the delay time when the PWM signal is transmitted to the clock delay circuit; and a PWM signal delay module, being configured to receive the PWM signal and output the PWM signal to the dimmer switch when the delay time of the counter expires.

* * * * *